United States Patent [19]

Arakawa

[11] Patent Number: 4,976,470

[45] Date of Patent: Dec. 11, 1990

[54] CONE CRUSHER

[75] Inventor: Kazuaki Arakawa, Osaka, Japan

[73] Assignee: Kurimoto, Ltd., Osaka, Japan

[21] Appl. No.: 365,017

[22] Filed: Jun. 12, 1989

[30] Foreign Application Priority Data

Mar. 30, 1989 [JP] Japan ..... 1-80985

[51] Int. Cl.[5] ..... B02C 2/04

[52] U.S. Cl. ..... 241/37; 241/215

[58] Field of Search ..... 241/207–216, 241/37, 286, 290

[56] References Cited

U.S. PATENT DOCUMENTS 2,556,641 6/1951 Bakewell ..... 241/215

*Primary Examiner*—Mark Rosenbaum

*Attorney, Agent, or Firm*—Jones, Tullar & Cooper

[57] ABSTRACT

An improved cone crusher wherein raw material is crushed between a gyrating mantle and a bowl liner above the mantle. Space between the mantle and the bowl liner is adjusted by moving the bowl liner upward, and the adjusting movement is automatically performed by hydraulic pressure applied evenly to the entire circumference, successfully meeting fluctuation of load and abnormal overload.

4 Claims, 8 Drawing Sheets

(a)

(b)

(c)

(a)

(b)

(c)

(d)

(a)

(b)

CONE CRUSHER

BACKGROUND OF THE INVENTION

1. Field of the invention:

The present invention relates to a cone crusher by which raw material such as ore is crushed between a gyrating mantle and a bowl liner mounted above the mantle.

2. Prior art:

In the cone crusher of the noted type, because raw material is fed and crushed between the mantle and the bowl liner, surfaces of both the mantle and the bowl liner are worn away and recede as a result of repetition of such a crushing operation, also the crushing space formed between the mantle and the bowl liner is gradually enlarged eventually resulting in lowering of crushing performance. It is, therefore, essential to adjust the crushing space by changing the position of either the mantle or the bowl liner with the progress of wear and tear.

In this positional adjustment, there are various factors to be considered which should be chosen between the mantle and the bowl liner. Both a mantle adjustment type crusher and a bowl liner adjustment type crusher have been put into practical use and improved in their positional adjustment so far. The two types of crushers are now compared from the viewpoint of their crushing performance after being subject to the positional adjustment with reference to FIGS. 5 (*a*) and (*b*).

The crushing performance of cone crusher can be comparatively expressed by "throw" on the condition that the configuration of the crushing chamber, number of gyrations and materials to be crushed are equal. In the drawings, the center line H of the mantle 44 and the center line J of the main shaft intersect each other at the point O at the top of the crusher, and the space between the line H and the line J becomes larger in the lower part.

FIGS. 5 (*a*) and (*b*) show a cone crusher in which the mantle 44 is moved upward to reduce (or adjust) the space between the mantle 44 and the bowl liner 31 in the event that the mantle 44 has been worn away and its surface receded. Referring to FIGS. 5 (*a*) and (*b*), the point G (the lowest point of the crushing chamber showing the maximum throw) is shifted upward to the point G1, whereby the throw is reduced by L1, which means lowering of the crushing performance by as much. On the other hand, when adjusting the space by moving the worn bowl liner 31 downward, FIGS. 5 (*c*) and (*d*) the point G is shifted downward to the point G2, and the throw is increased by L2, which means improvement of the crushing performance by as much.

Accordingly, as far as the crushing performance is concerned, it may be said that the bowl liner adjustment type crusher is superior to the mantle adjustment type one. This bowl liner adjustment type crusher has been further classified into various subtypes each having been improved in their own way.

FIG. 6 shows a cone crusher most popularly used, in which a cylindrical member 3*a*, to which the bowl liner 31*a* is fixed to be mounted above an mantle 44*a*, is engaged with the upper frame 2*a* by a bolt (not shown). Thus, the bowl liner 31*a* can be moved up and down by turning the bolt thereby also turning the bowl liner, whereby the space between the bowl liner 31*a* and the mantle 44*a* is adjusted.

In the event of receiving any abnormal shock (due to excessive feed of raw material, for example) at the crushing chamber of the crusher of this type, the shock may be absorbed at four corners of the crusher where upper frame 2*a* and lower frame 1*a* are secured to each other with a plurality of spring jacks 101.

Japanese Patent Application Publication (examined) No. Sho 39-6929 discloses as shown in FIGS. 7 (*a*) and (*b*) a crusher in which a cylindrical member 3*b*, to which the bowl liner 31*b* is fixed, is slidably inserted in a cap frame 2*b* of the main frame, and the cylindrical member 3*b* is supported telescopically with a plurality of fluid cylinders 102.

This prior art is intended to smoothly shocks, and to perform positional adjustment of the bowl liner 31*b* in the vertical direction by converting the rotation of a fluid motor 103 into vertical movement of a setting adjust bar 104, thereby "vertically" and "the" —sliding— vertically the cylindrical member 3*b* to draw up the bowl liner 31*b*.

Japanese Patent Application Publication (examined) No. Sho 61-26424 also employs a method of moving a bowl liner 31*c* upward, as shown in FIGS. 8 and in which a rod 105 is disposed between an upper frame 2*c* and a lower frame 1*c* so that the cylindrical member 3*c* may slide vertically within the upper frame 2*c* by telescopically moving the rod with a cylinder 106.

Among the foregoing prior art, the most popular cone crusher shown in FIG. 6 has a disadvantage of requiring too much time and labor for providing taps on the inner and outer peripheries of large and heavy components (i.e., upper frame 2*a* and cylindrical member 3*a*). Moreover, because the crushing load is absorbed by means of springs, the upper frame may be violently moved up and down in the event of excessive load eventually resulting in early wear and tear of the portion of the upper frame engagedly inserted into the lower frame 1*a*. Since the shocks due to fluctuation of the load are abosorbed by the plurality of spring jacks, adjustment exactly following vertical movements of the cylindrical member is very difficult. Besides, it is not easy for the bowl liner 31*a* to be turned in a required circumferential direction to be reset to an adjusted position because it is quite rare that a partially worn part of the bowl liner is coincident with turning of the bolts for vertical movement of the bowl liner when the bowl liner is worn away.

When employing the cone crushers shown in FIGS. 7 and 8 in which absorption of overload and positional adjustment of the bowl liner are both carried out by the plurality of liquid cylinders, there is a disadvantage that it is difficult to keep a balance with respect to the entire circumference resulting in application of partial load if an insufficient number of such cylinders are disposed. On the contrary, if a large number of such cylinders are disposed, there is another disadvantage that it is difficult to cause every cylinder to perform a harmonious and uniform function eventually requiring troublesome fine adjustment.

SUMMARY OF THE INVENTION

The present invention was made to solve the above-discussed problems and has an object of providing a novel cone crusher in which space between a mantle and a bowl liner can be adjusted without lowering the crushing performance thereof, and which is capable of successfully absorbing overload and meeting partial abrasion of the bowl liner.

In order to accomplish the foregoing object, the cone crusher in accordance with the invention is characterized by comprising: a cylindrical member to which a bowl liner is fixed and which is slidably and rotatably engaged with a cylinder forming an internal surface of an upper frame; an annular oil chamber which is internally provided on a sliding surface between the cylinder and the cylindrical member; and a hydraulic mechanism which is mounted on an external surface of the upper frame to be connected to the oil chamber.

It is preferable that the crusher comprises a plurality of annular oil chambers which are provided vertically each connecting switchably connected to a hydraulic pressure generator, and a pressure control valve which is connected in parallel between two oil chambers to apply a certain gas pressure only to one of the oil chambers through a flexible pipe at all times. It is also preferable that a bearing portion of the piston cylinder and the cylindrical member is formed of an elongated plate inserted in a plurality of concave grooves provided on the sliding surface.

In the cone crusher of the above construction, the cylindrical member 3 receiving a hydraulic pressure moves up and down together with the bowl liner 31, and the space between the bowl liner 31 and the mantle 44 is adjusted as desired. The vertical movement of the cylindrical member for the adjustment is performed by a driving force applied evenly from the annular oil chamber to the entire circumference, and the vertical movement progresses smoothly at a constant level. It is to be noted that this adjustment can be made even during the operation of the cone crusher.

In the same manner, load fluctuation occuring during normal operation of the crusher is evenly absorbed throughout the circumference. In the event of abnormal overload, the shock thereby is received by the entire circumference and actuation of the hydraulic mechanism is induced to generate the driving force to avoid breakdown of the crusher.

The surface of the bowl liner is not partially worn away, but is evenly worn away throughout the circumference because it is rotatably held in the crushing chamber.

As a result of the foregoing consturction and function of the invention, the cylindrical inner surface of the upper frame forming a cylindrical member and the cylindrical member with the bowl liner fixed thereto forming a piston cylinder are hydraulicly controlled respectively to carry out absorption of vibration during operation, handling of foreign materials fed a and shift of position of the worn bowl liner. Furthermore, because the hydraulic mechanism can be small-sized, light-weight and simplified to the extent of being easily attachable to the external surface of the upper frame, the cone crusher of the invention is more advantageous than the prior art from the viewpoint of occupying area, installation cost and maintenance.

Because the position of the bowl liner in the circumferential direction is rotatably changed at the time of crushing, the bowl liner is free from partial abrasion, and the entire surface thereof is evenly worn away. The position of the bowl liner can also be changed in the vertical direction when required, thereby enabling the cone crusher of the invention to be smoothly operated for a long period of time exhibiting its proper performance originally designed.

Other objects and advantages of the invention will become apparent in the course of the following description with the accompanying drawings.

DESCRIPTION OF THE PREFERRED EMBODIMENT

Described hereinafter is an embodiment in accordance with the present invention.

Figure 1:
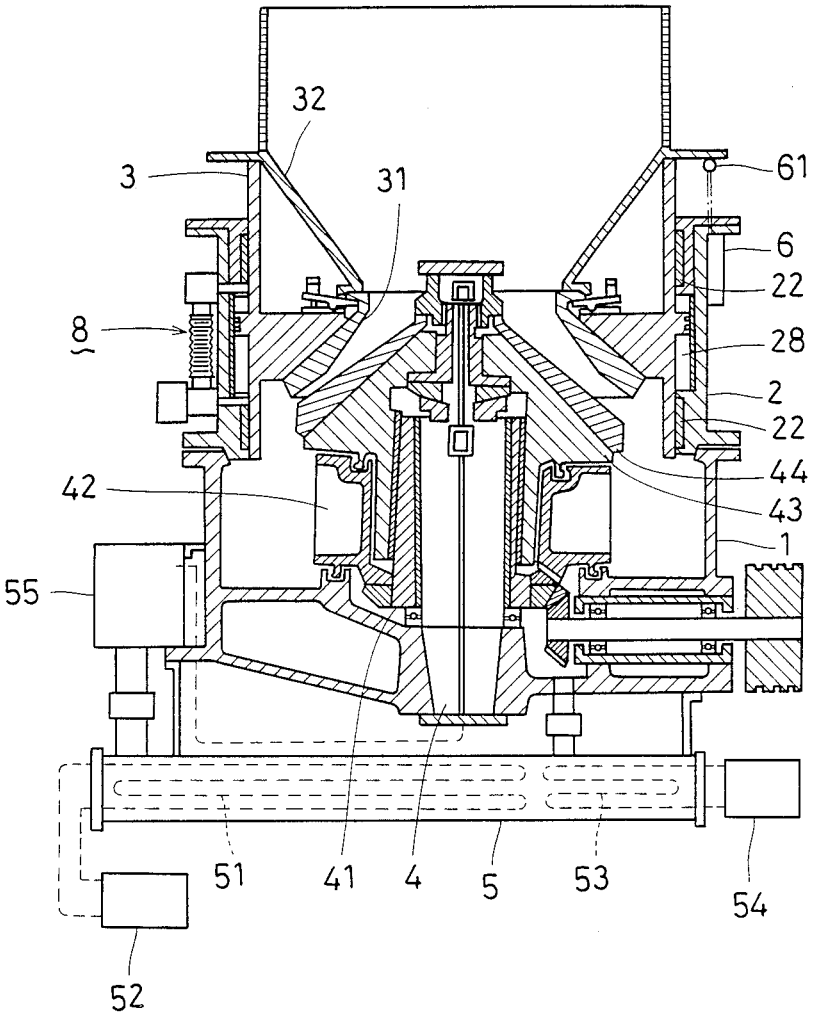
FIG. 1 is a front sectional view of an embodiment in accordance with the present invention.

Referring to FIG. 1 there is shown a front sectional view of an entire crusher, an upper frame 2 being placed on a lower frame 1. In the upper frame 2, the internal cylindrical surface forms a cylinder, and a cylindrical member 3 is inserted inside the cylinder thereby forming a piston as a whole. A bowl liner 31 is fixed to the cylindrical member 3 and is held by the piston bearing 22. A gyrating cone is mounted on the middle part of the lower frame 1. More specifically, the main shaft 4 is engaged with the bottom part of the lower frame 1 and is rotatably inserted in an eccentric cylinder 41. The eccentric cylinder 41 is rotatably inserted in a mantle core 43. A driving bevel gear and a balance cylinder 42 are fixed to the lower part of the eccentric cylinder 41 to turn together. The mantle core 43 is covered with the mantle 44 so that a crushing chamber is formed by the external surface of the mantle 44 and the surface of the bowl liner 32 facing the mantle 44' both serving as crushing surfaces.

An oil chamber 28 disposed between the internal cylindrical surface of the upper frame 2 and the cylindrical member 3 is connected to a hydraulic mechanism 8 mounted on a part of the external surface of the upper frame, and a detector 6 is attached to the other part of the external surface. The top end of the detector 6 is formed into a rotatable spherical contact 61 being in contact with a hopper 32 fixed to the cylindrical member 3.

An elongated lubricating oil tank 5 is disposed under the lower frame 1, and a lubricating oil control unit 5 connected to the oil tank 55 is disposed on one side. A cooling pipe 51 and a heating pipe 53 are disposed in the lubricating oil tank 5, the former being connected to a cooling controller 52 and the latter being connected to the heating controller 54, respectively.

Figure 2:
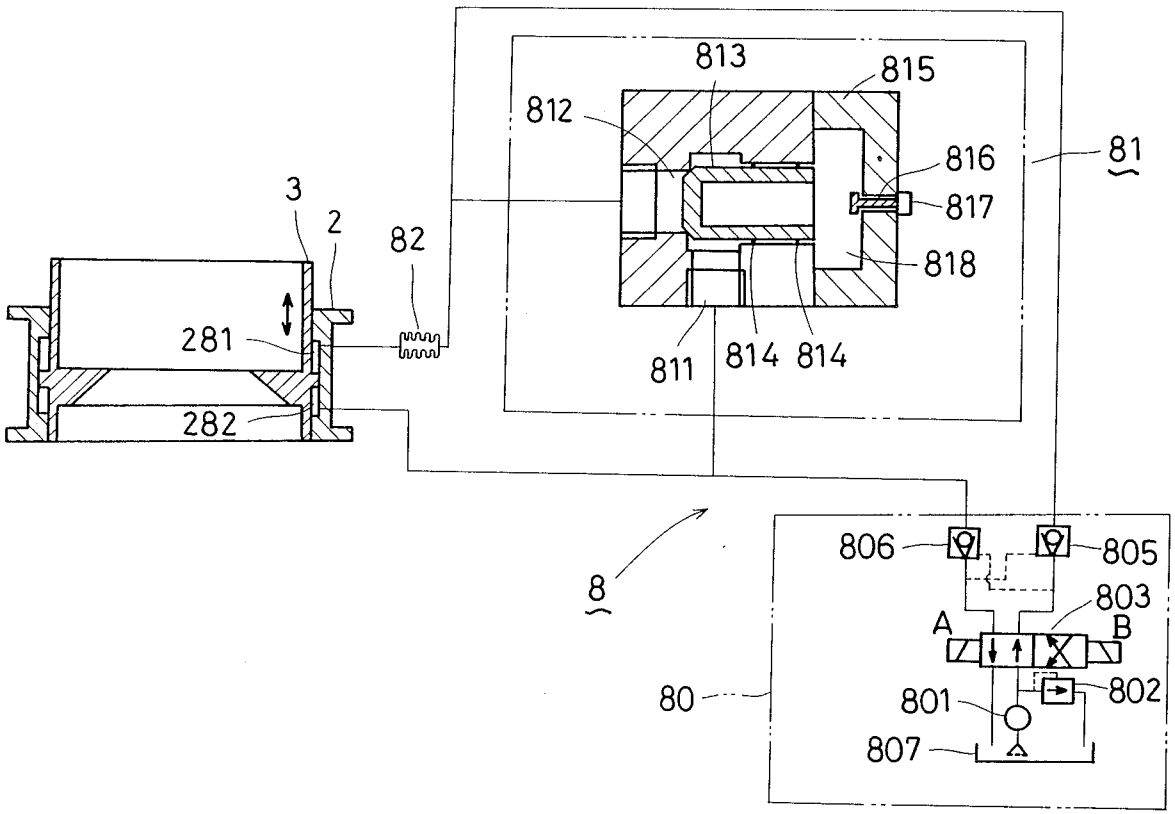
FIG. 2 is a partial circuit diagram of the hydraulic mechanism of the embodiment of FIG. 1.

Referring to FIG. 2 showing in detail a circuit diagram of the hydraulic mechanism 8 to control vertical movement of the cylindrical member 3, the oil chamber 28 comprises two superposed annular cavities, i.e., upper oil chamber 281 and lower oil chamber 282 each having an equal sectional area. The upper and lower oil chambers are respectively provided with openings communicated with the outside of the upper frame.

Oil in the upper oil chamber 281 passes through the metal flexible pipe 82 to communicate with the pressurizing side 812 of a pressure control valve 81 and with a pilot check valve 805 of an hydraulic pressure generator 80. On the other hand, the lower oil chamber 282 communicates with the discharging side of the pressure control valve 81 and with a pilot check valve 806.

In the pressure control valve 81, a spool 813 is pressed against the pressurizing side 812 by application of a gas pressure supplied from a nitrogen gas sealing chamber 818 disposed on the opposite side of the pressurizing side 812. When actuating the pump 801 of the hydraulic pressure generating device 80, the oil passes through the pilot check valve 805 and the metal flexible pipe 82 to enter the upper oil chamber, thus an oil pressure is generated to move the cylindrical member 3 down. This oil pressure releases the pilot check valve 806 and returns the oil in the lower oil chamber 29 to an oil tank 807. Accordingly, the cylindrical member 3 is smoothly moved downward.

When actuating the side B of a change-over valve 803, pressurized oil is supplied to the lower oil chamber 282 and the oil in the upper oil chamber 281 is discharged, thus the cylindrical member 3 is moved upward. A crushing load at the time of crushing between the mantle 44 and the bowl liner 31 acts on the bowl liner 31 in a direction to move it upward. Accordingly, the cylindrical member 3 tries to move itself upward by increasing the oil pressure in the upper oil chamber 281. However, because the spool 813 pressed by the nitrogen gas pressure and the pilot check valve 805 are not operated, the cylindrical member 3 is not moved upward, thus the crushing operation is continued. In the event that a large crushing load is applied giving large shocks to the entire crusher, oil pressure in the upper oil chamber 281 is sharply increased thereby vibrating the crusher body to the extent of resulting in early wear and tear of the crusher. For the purpose of preventing such a situation, any shocking surge pressure or delay in actuation of the pressure control valve can be absorbed by expansion and contraction of the metal flexible pipe 82. In the event that more excessive overload is given to the cylindrical member 3 due to feed of some foreign materials, for example, the spool 813 of the pressure control valve 81 overcomes the nitrogen gas pressure and moves to the nitrogen gas seal chamber 818 side. As a result, the pressurized oil in the upper oil chamber 281 flows from the pressurizing side 282 of the pressure control valve 81 to the discharging side 811, then entering the lower oil chamber 292. Since the sectional areas of the upper and lower oil chambers are equal, an amount of oil corresponding to the moved volume of the piston 3 is shifted from the upper oil chamber 281 to the lower oil chamber 282, thus solving the problem of overload.

Figure 3:
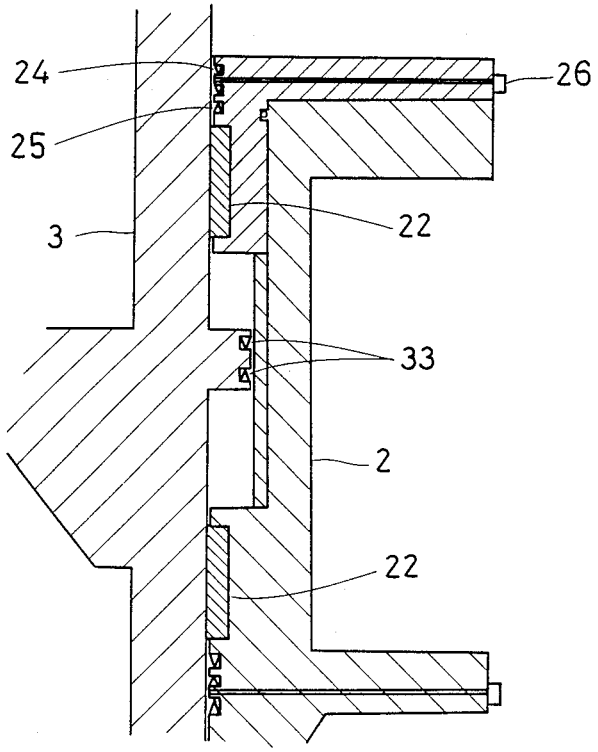
FIG. 3 is a cross sectional view of the sliding section of the embodiment of FIG. 1.

Referring to FIG. 3 showing an enlarged view of the internal circumferential part of the upper frame 2, the cylindrical member 3 held by the piston bearing 22 slides vertically, and the oil chamber is formed by the packing 33 provided on the cylindrical member and the packing 25 provided on the upper frame. Two dust seals 24 are disposed in parallel on the outside of the packing 25, and a grease feeding port 26 is provided between them so that the gap between the two dust seals is filled with grease. In this manner, dust is prevented from entering the piston bearing 22 from outside.

Figure 4:
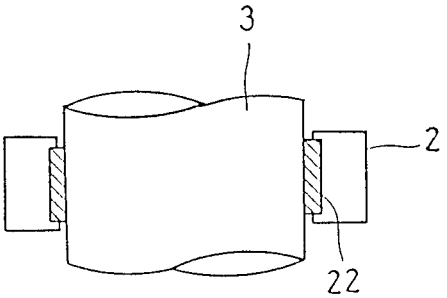
FIG. 4 (*a*), (*b*) and (*c*) are respectively a partial sectional front view, a perspective view and a perspective view of a piston bearing.
Figure 4:
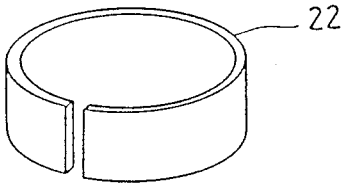
Figure 4:
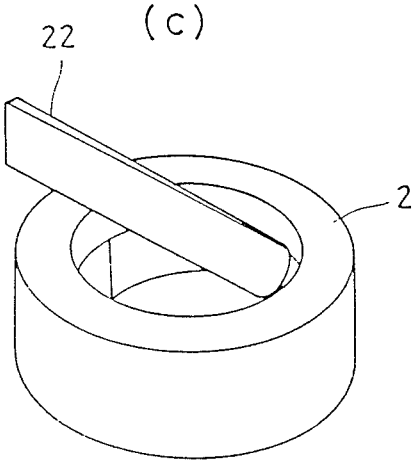
Figure 5:
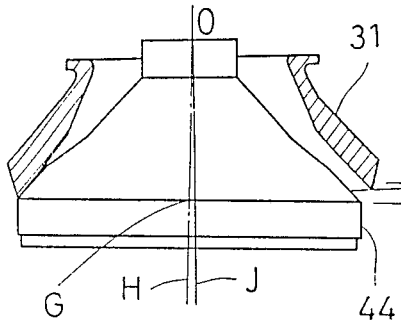
FIG. 5 (*a*), (*b*), (*c*) and (*d*) are front partial sectional schematic views which explain the crushing efficiency of a cone crusher.
Figure 5:
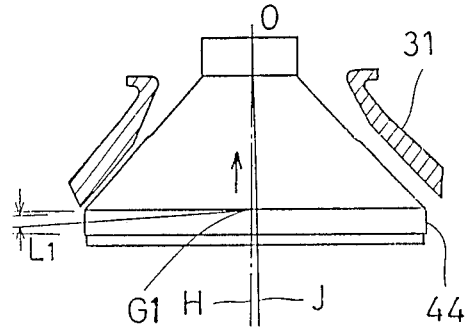
Figure 5:
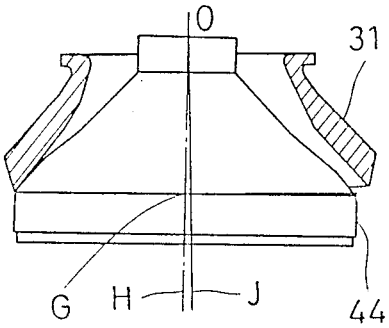
Figure 5:
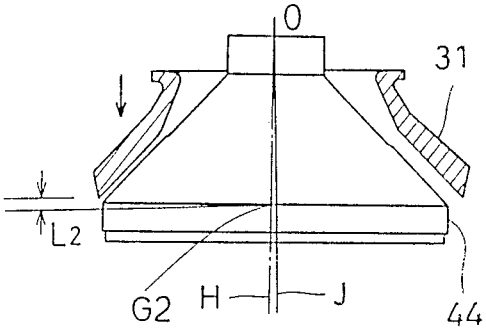
Figure 6:
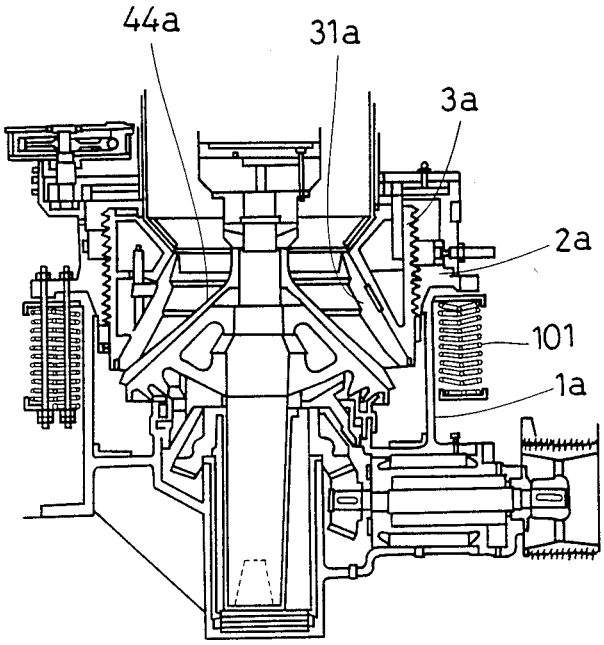
Fig. 6 PRIOR ART
FIGS. 6, 7 (*a*), (*b*) and 8 are respectively front partial sectional views of various prior art cone crushers.
Figure 7:
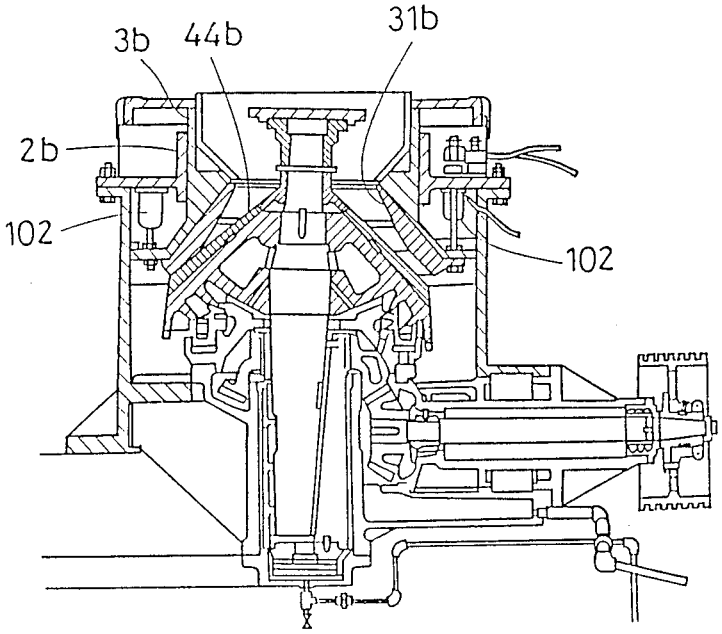
Fig. 7 PRIOR ART
Figure 7:
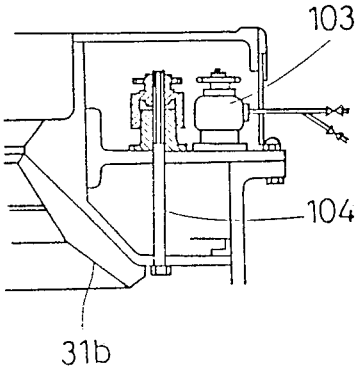
Figure 8:
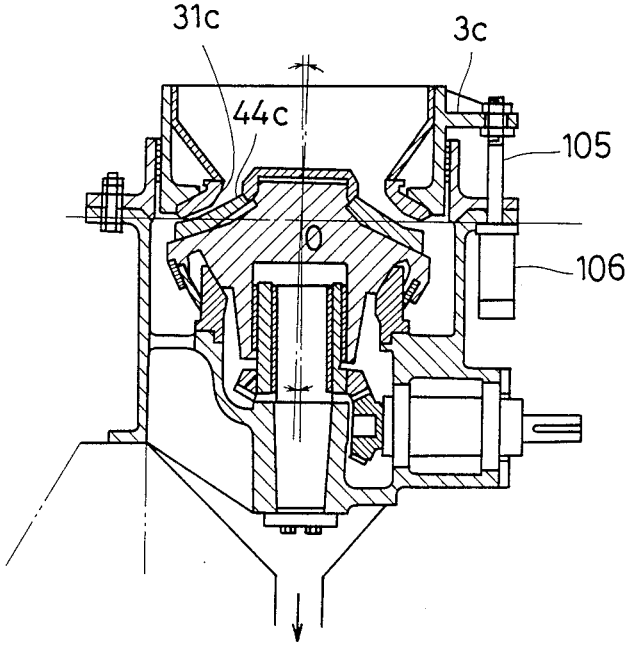
Fig. 8 PRIOR ART

FIG. 4 (*a*), (*b*) and (*c*) show a preferred embodiment of the piston bearing 22 mounted on the sliding surface formed between the cylindrical member 3 and the internal cylindrical surface of the upper frame 2.

In the prior art, a cylindrical material was formed into a hollow annular cylinder by cutting internal and external surfaces as well as top and bottom sides with machine tool. Then, a piston bearing was engagedly inserted in the annular stepped portions formed on the sliding surface by cutting, then the top end face was fixedly held with a metal holder.

On the other hand, in the embodiment shown in FIG. 4 (*a*), the internal cylindrical surface of the upper frame 2 is provided with an annular groove, then an elongated plate corresponding to the circumferential length of the groove is engagedly inserted in the groove, thus forming a bearing section.

FIG. 4 (*b*) shows a bearing of metal plate, which is formed into a cylinder having its external circumferential length shorter than that of the groove of the cylindrical member and its diameter slightly larger than the diameter of the annular groove, is inserted in the groove utilizing elasticity made of a the metal.

FIG. 4 (*c*) shows a bearing of resin plate, which is directly inserted in the groove utilizing plastic deformation of the material.

In any of the foregoing embodiments, neither a metal holder nor a clamping bolt used in the prior art are required, and no cylindrical material and machining work thereof are required, either, eventually resulting in such advantages as economy, saving in number of parts, compact crusher.

What is claimed is:

1. A cone crusher for crushing raw material, such as ore, comprising:

a mantle;

a bowl liner;

a cylinder;

a cylindrical member to which the bowl liner is fixed to be mounted above said mantle, said cylindrical member being slidably and rotatably engaged with said cylinder, forming thereby an internal surface of an upper frame;

a hydraulic pressure generating device;

a plurality of annular oil chambers, internally provided on a sliding surface between the cylinder and the cylindrical member, said oil chambers being vertically oriented and each being switchably connected to said hydraulic pressure generating device;

a flexible pipe; and a pressure control valve provided in parallel with said hydraulic pressure generating device, forming a bypass to apply, through said flexible pipe, a certain pressure at all times to only one oil chamber at a time.

2. The cone crusher as defined in claim 1, wherein the hydraulic pressure generating device is mounted on an external surface of the upper frame.

3. The cone crusher as defined in claim 2, further comprising:

an elongated plate, wherein a plurality of grooves are provided on the sliding surface between the cylinder and the cylindrical member, and wherein a bearing section is formed of the elongated plate inserted in the plurality of grooves.

4. The cone crusher as defined in claim 1, further comprising:

an elongated plate, wherein a plurality of grooves are provided on the sliding surface between the cylinder and the cylindrical member, and wherein a bearing section is formed of the elongated plate inserted in the plurality of grooves.

* * * * *